US007128696B1

(12) United States Patent
Krull

(10) Patent No.: US 7,128,696 B1
(45) **Date of Patent: *Oct. 31, 2006**

(54) ADJUSTABLE MASS EXERCISE APPARATUS AND METHODS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 354 days.

This patent is subject to a terminal disclaimer.

(21) Appl. No.: 10/428,178

(22) Filed: Apr. 30, 2003

Related U.S. Application Data

(60) Provisional application No. 60/377,996, filed on May 2, 2002.

(51) Int. Cl.
*A63B 21/072* (2006.01)
*A63B 21/075* (2006.01)

(52) U.S. Cl. ..... 482/107; 482/108

(58) Field of Classification Search ..... 482/93, 482/104, 106–108
See application file for complete search history.

(56) References Cited

U.S. PATENT DOCUMENTS

| | | | | |
|---|---|---|---|---|
| 4,529,198 | A * | 7/1985 | Hettick, Jr. | 482/104 |
| 5,637,064 | A * | 6/1997 | Olson et al. | 482/108 |
| 6,228,003 | B1 * | 5/2001 | Hald et al. | 482/107 |
| 6,719,674 | B1 * | 4/2004 | Krull | 482/106 |
| 6,749,547 | B1 * | 6/2004 | Krull | 482/106 |
| 6,776,741 | B1 * | 8/2004 | Burwell | 482/108 |
| 2002/0183174 | A1 * | 12/2002 | Chen | 482/108 |
| 2004/0005969 | A1 * | 1/2004 | Chen | 482/107 |

* cited by examiner

*Primary Examiner*—Jerome Donnelly
*Assistant Examiner*—Tam Nguyen

(57) ABSTRACT

An exercise dumbbell includes a handle member and weight plates maintained in spaced relationship relative thereto. The handle member has a dedicated weight selector for each of the weight plates. Each weight selector is movable into and out of engagement with a respective weight plate. As a result, different combinations of the weight plates may be secured to the handle.

20 Claims, 13 Drawing Sheets

Fig. 4
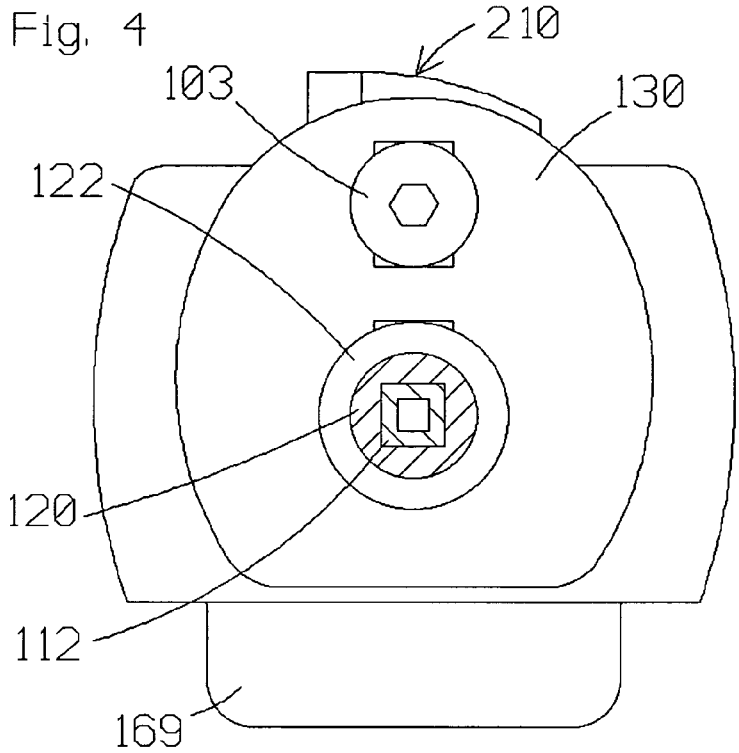
Fig. 5
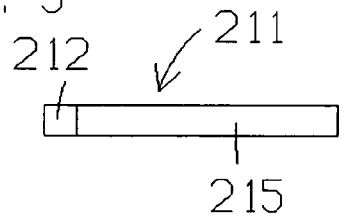
Fig. 7
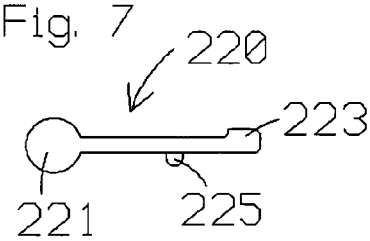
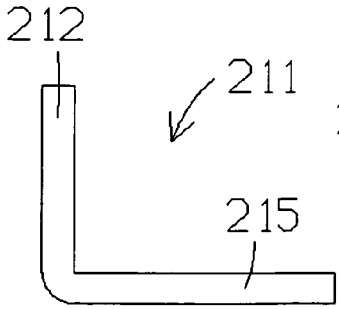
Fig. 6
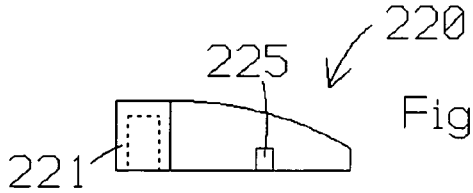
Fig. 8
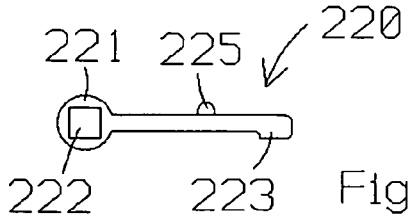
Fig. 9

Fig. 24
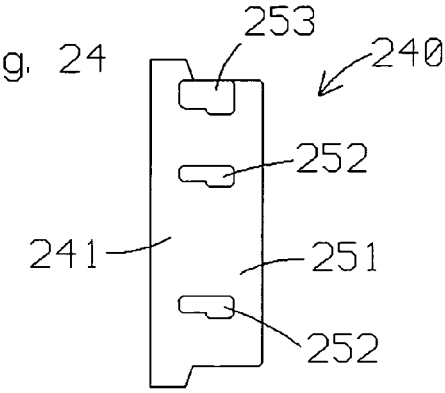
Fig. 26
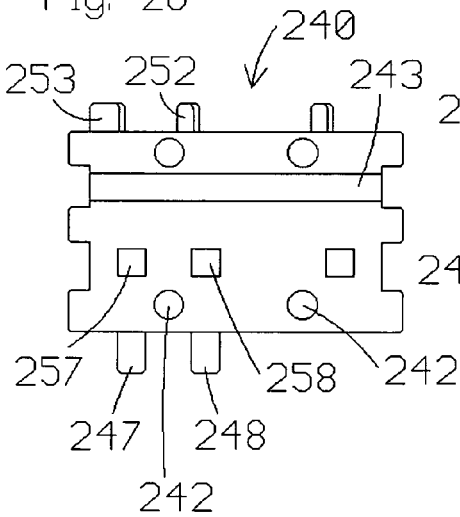
Fig. 23
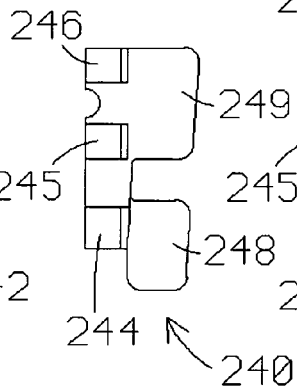
Fig. 27
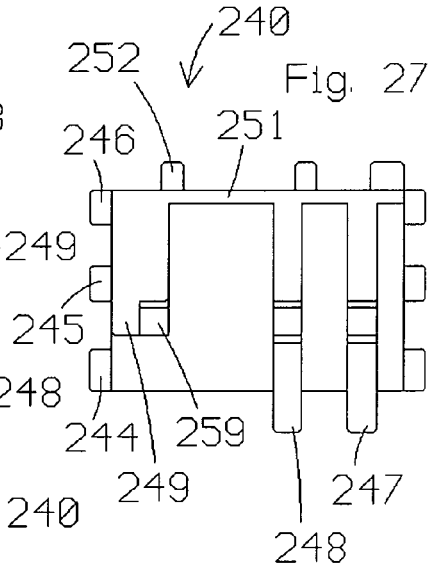
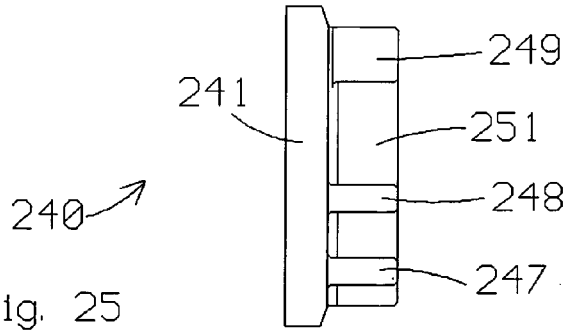
Fig. 25

Fig. 34
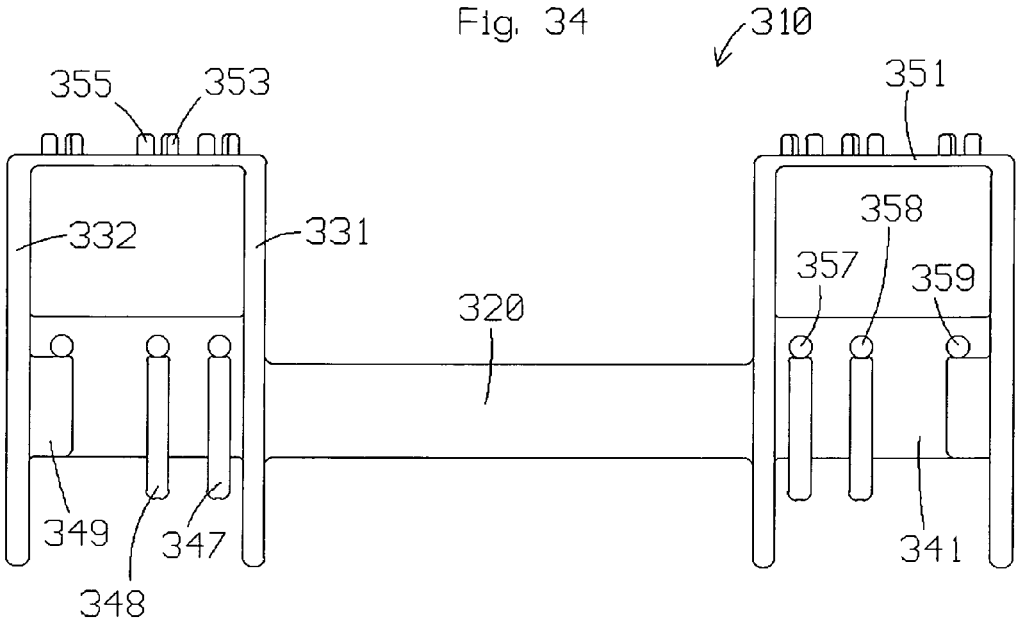
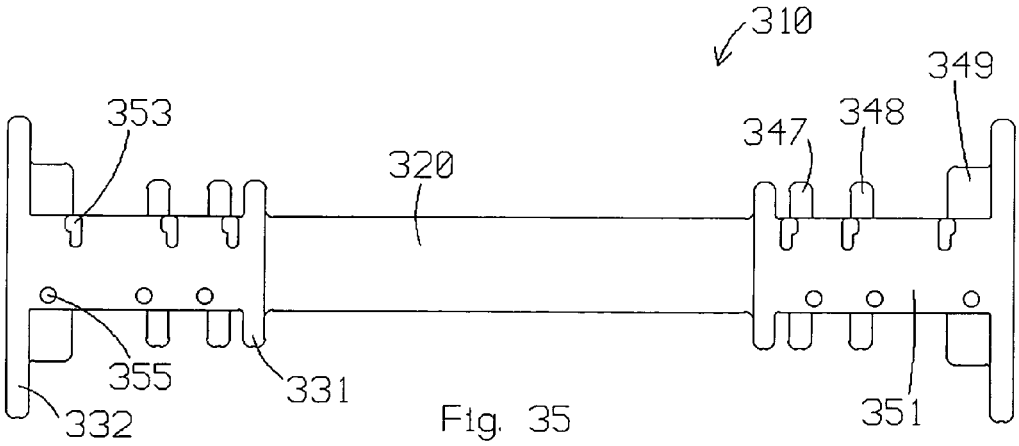
Fig. 35

ADJUSTABLE MASS EXERCISE APPARATUS AND METHODS

CROSS-REFERENCE TO RELATED APPLICATION

Disclosed herein is subject matter that is entitled to the filing date of U.S. Provisional Application No. 60/377,996, filed on May 2, 2002.

FIELD OF THE INVENTION

The present invention relates to exercise equipment and more particularly, to methods and apparatus for adjusting weight resistance to exercise activity.

BACKGROUND OF THE INVENTION

An object of the present invention is to provide improved apparatus and/or methods for selecting different combinations of weight to resist exercise movement.

SUMMARY OF THE INVENTION

The present invention provides methods and apparatus involving the movement of mass subject to gravitational force. In a preferred application, the present invention allows a person to adjust weight resistance by securing a desired amount of mass to opposite ends of a weight lifting member.

In one respect, the present invention may be described in terms of an exercise dumbbell, comprising a handle member that defines a longitudinal axis; first weight supports mounted on a first end of the handle member; and second weight supports mounted on a second end of the handle member; first end weights configured to be supported in respective, axially spaced positions defined by the first weight supports, wherein the first end weights include a first weight and a second weight; second end weights configured to be supported in respective, axially spaced positions defined by the second weight supports, wherein the second end weights include a third weight and a fourth weight; and for each said weight, a dedicated weight selector movably mounted on the handle member and movable between a first position, underlying a portion of a respective said weight, and a second position, free to move upward relative to a respective said weight.

In another respect, the present invention may be described in terms of an exercise dumbbell, comprising a handle member having an intermediate hand grip that defines a longitudinal axis, and opposite ends that are configured to accommodate respective weight plates; a plurality of weight plates, including a first weight plate having an axially projecting lip, and a second weight plate having an axially projecting lip; and a plurality of weight selectors on the handle member, including a first weight selector that is configured and arranged to slide beneath the lip on the first weight, and a second weight selector that is configured and arranged to slide beneath the lip on the second weight.

In yet another respect, the present invention may be described in terms of an exercise dumbbell, comprising weight plates; a handle member that defines a longitudinal axis, wherein axially spaced openings extend through the handle member in a direction perpendicular to the longitudinal axis; weight selectors sized and configured for insertion into respective openings in the handle member and into engagement with respective weight plates; and a base sized and configured to maintain the weight plates in position to receive respective weight selectors when the handle member is resting on at least one of the base and the weight plates.

Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 4 is a sectioned end view of the dumbbell and weight plates of FIG. 1, taken along the section line 4—4;

FIG. 5 is a top view of a selector pin on the handle member of FIG. 1;

FIG. 6 is an end view of the selector pin of FIG. 5;

FIG. 7 is a top view of a selector latch on the handle member of FIG. 1;

FIG. 8 is an end view of the selector latch of FIG. 7;

FIG. 9 is a bottom view of the selector latch of FIG. 7;

FIG. 23 is an end view of a second weight support member on the handle member of FIG. 1;

FIG. 24 is a top view of the weight support member of FIG. 23;

FIG. 25 is a bottom view of the weight support member of FIG. 23;

FIG. 26 is a side view of the weight support member of FIG. 23;

FIG. 27 is an opposite side view of the weight support member of FIG. 23;

FIG. 34 is a side view of a handle member that is a part of the dumbbell of FIG. 31;

FIG. 35 is a top view of the handle member of FIG. 34;

DETAILED DESCRIPTION OF A PREFERRED EMBODIMENT

Figure 1:
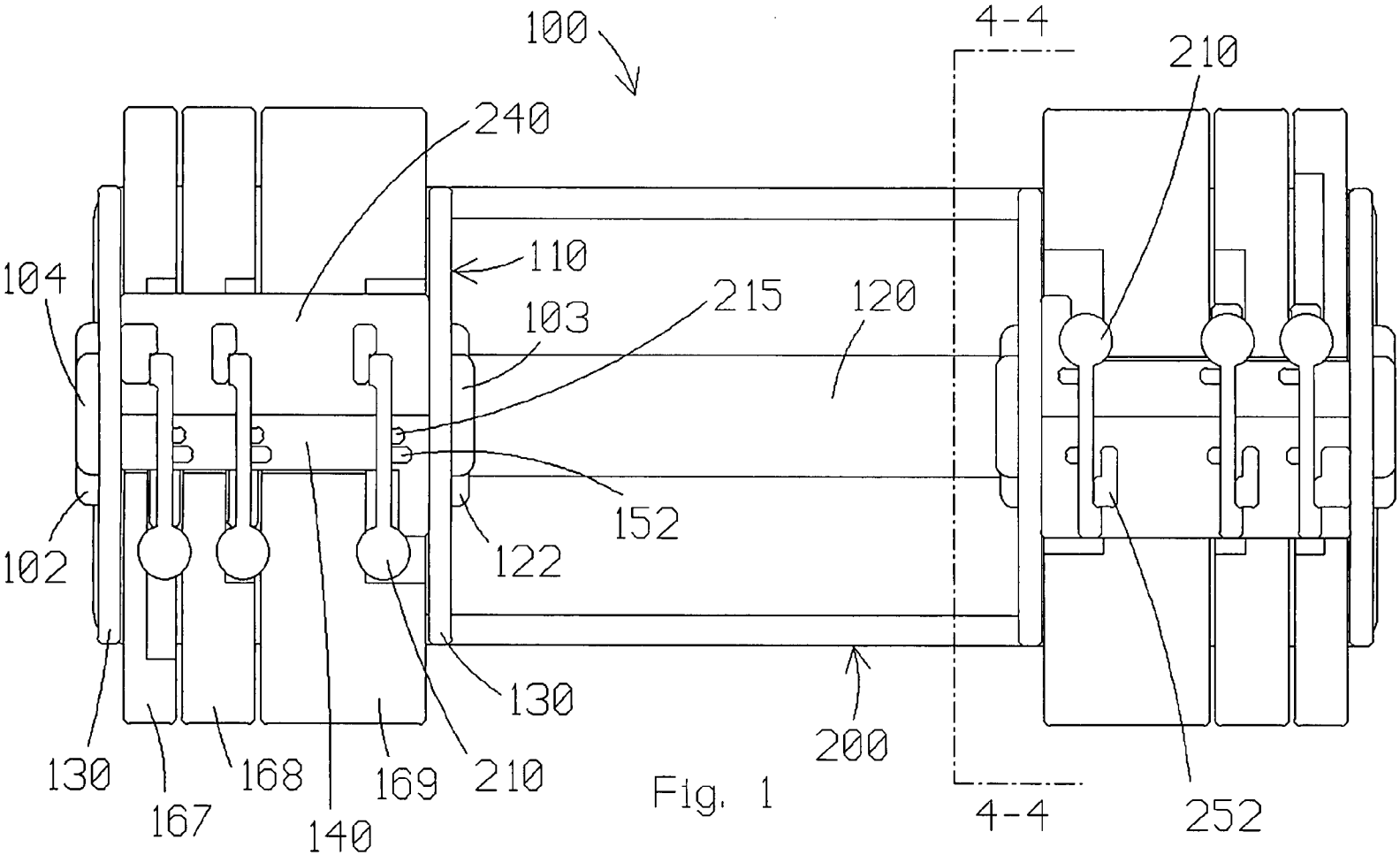
FIG. 1 is a top view of an adjustable weight dumbbell system constructed according to the principles of the present invention, including a handle member, a base, and weight plates supported on the base and selectively connected to the handle member.

An exercise dumbbell system constructed according to the principles of the present invention is designated as 100 in FIG. 1. The dumbbell system 100 includes a weight lifting member or handle member 110, a plurality of weight plates 167–169 that are selectively secured to the handle member 110, and a base 200 that is configured to support the weight plates 167–169 when not in use.

Figure 2:
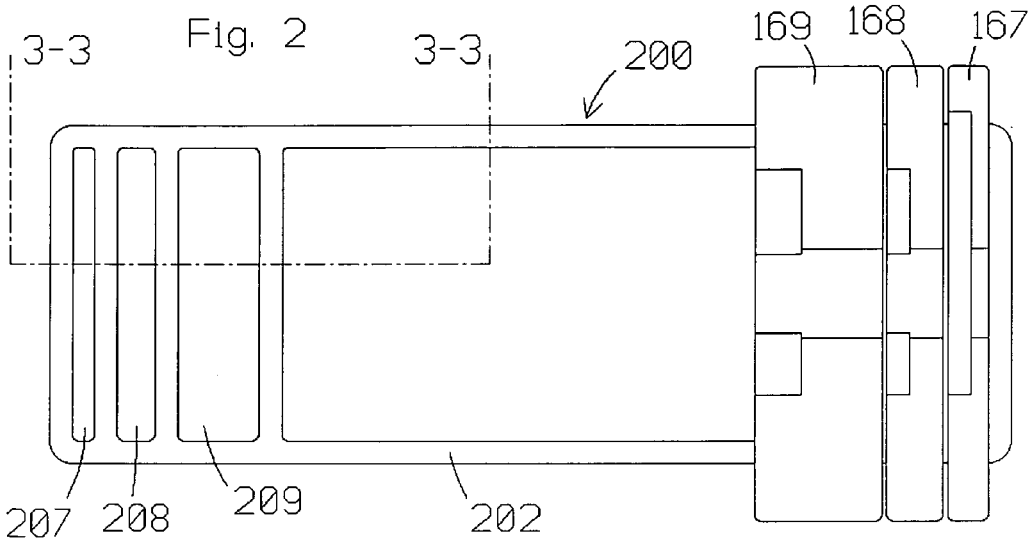
FIG. 2 is a top view of the base of FIG. 1 supporting only a group of weight plates from one end of the dumbbell system of FIG. 1.
Figure 3:
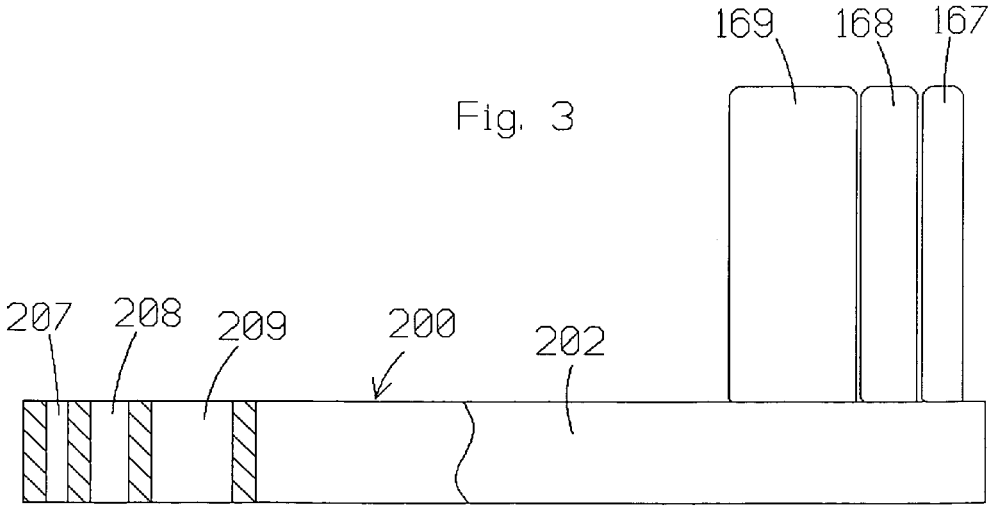
FIG. 3 is a partially sectioned side view of the base and weight plates of FIG. 2, taken along the section line 3—3.
Figure 12:
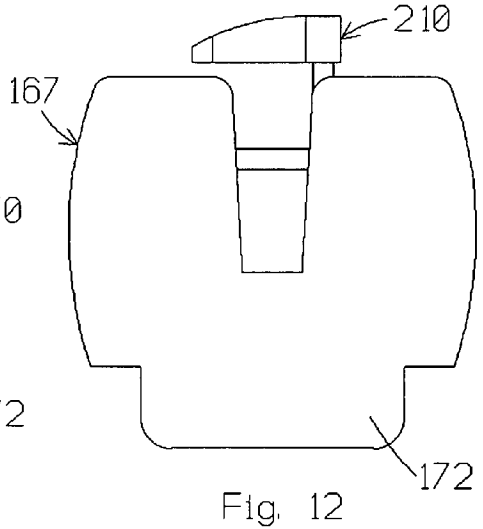
FIG. 12 is an opposite end view of the weight plate, selector pin, and selector latch of FIG. 10.
Figure 11:
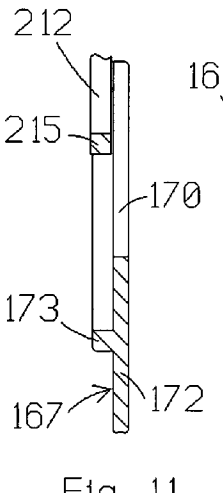
FIG. 11 is a sectioned side view of the weight plate and selector pin of FIG. 10, taken along the section line 11—11.
Figure 10:
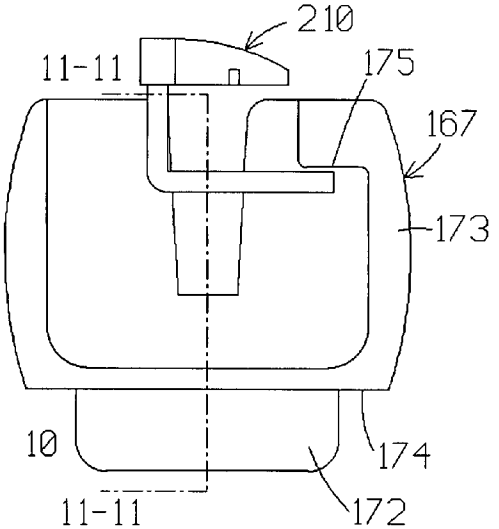
FIG. 10 is an end view of a first weight plate shown in FIG. 1, shown together with the selector pin of FIG. 5 and the selector latch of FIG. 7.

As shown in FIGS. 2–3, the base 200 includes opposite end weight compartments that are interconnected by intermediate rails or walls 202. Each weight compartment defines three slots 207–209 that are configured to receive respective weight plates 167–169, and each weight compartment is bounded by opposite sidewalls that are configured to support respective shoulders on the weight plates 167–169. This particular base 200 may be considered advantageous to the extent that it may be formed by extrusion (because it has a uniform profile as viewed from above or below), and/or it is narrower than the width of the weight plates 167–169 (and thus, less expensive to manufacture). In any event, the dumbbell 100 may be used in conjunction with other base configurations in the alternative.

The handle member 110 includes a bar 112 (shown in FIG. 4) that is preferably a square tube made of steel. The bar 112 extends substantially the entire length of the handle member 110. A hand grip 120 is mounted on an intermediate portion of the bar 112. The hand grip 120 is preferably a cylindrical tube made of plastic, and its exterior may be knurled and/or contoured to facilitate a comfortable and reliable grip. The hand grip 120 is configured to fit snugly onto the bar 112 in a manner that prevents rotation relative thereto.

First and second washers or covers 122 are mounted on opposite ends of the bar 112 and bear against respective ends of the hand grip 120. First and second end plates 130 are then mounted on opposite ends of the bar 112 and bear against respective washers 122. Like the hand grip 120, the end plates 130 and the washers 122 are configured to fit snugly onto the bar 112 in a manner that prevents rotation relative thereto.

Figure 30:
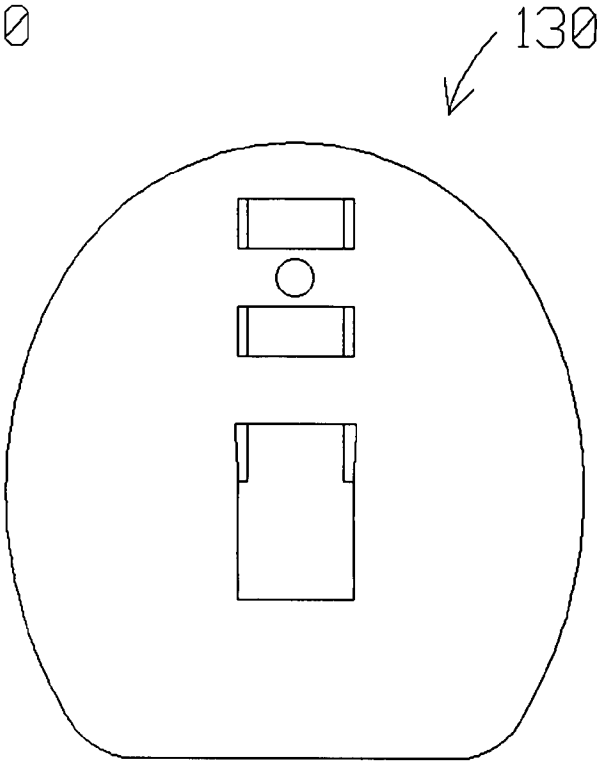
FIG. 30 is an opposite end view of the end plate of FIG. 28.
Figure 29:
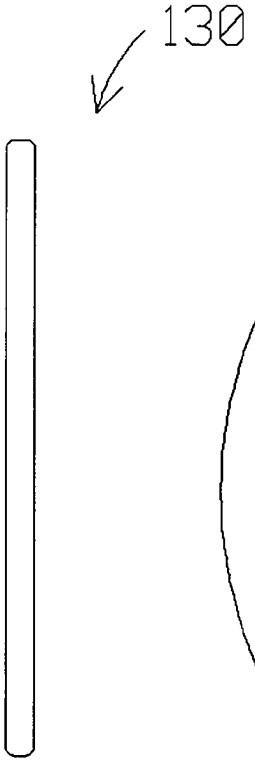
FIG. 29 is a side view of the end plate of FIG. 28.
Figure 28:
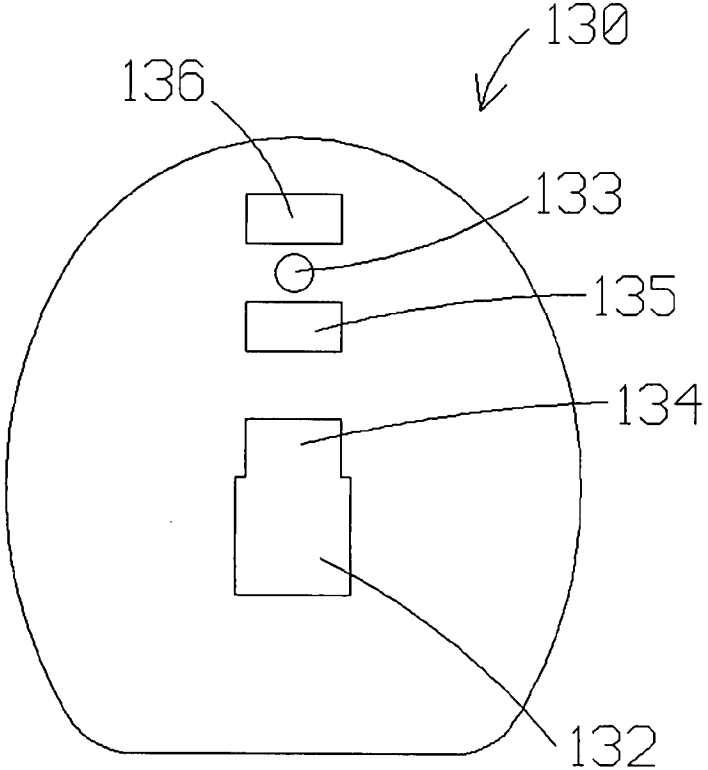
FIG. 28 is an end view of an end plate on the handle member of FIG. 1.

One of the end plates 130 is shown by itself in FIGS. 28–30. A square hole 132 extends through the end plate 130 to receive the bar 112. An upper end of the hole 132 is exposed to a rectangular notch or opening 134 having opposite sidewalls that extend in convergent fashion away from the weight plates 167–169 on the dumbbell 100 in FIG. 1. As shown in FIG. 4, the washers 122 are configured to span or cover at least part of the notch 134. Two additional rectangular openings 135 and 136 extend through an upper portion of the end plate 130 and have similarly angled sidewalls. A circular hole 133 extends through the end plate 130 at a location between the openings 135 and 136.

On each end of the handle member 110, first and second weight support members 140 and 240 are interconnected to one another and between respective inner and outer end plates 130. In other words, two end plates 130 are mounted on each end of the bar 112 with a set of first and second weight support members 140 and 240 disposed therebetween. Each of the support members 140 and 240 is preferably made of plastic and formed by injection molding.

One of the support members 140 is shown by itself in FIGS. 18–22. The support member 140 includes a base or body 141 having a shape that may be described generally as a parallelepiped. Cylindrical posts 142 project outward from a side of the base 141, and a semi-cylindrical groove 143 extends along the same side of the base 141. Flanges 147–149 project outward from an opposite side of the base 141, and square holes 157–159 extend through the base 141 proximate respective flanges 147–149 and perpendicular to the associated side of the base 141. Tabs 144–146 project outward from opposite ends of the base 141, and pegs 152 project outward from a top wall of the base 141.

One of the support members 240 is shown by itself in FIGS. 23–27. The support member 240 includes a base or body 241 having a shape that may be described generally as a parallelepiped. Cylindrical holes 242 extend into a side of the base 241, and a semi-cylindrical groove 243 extends along the same side of the base 241. The holes 242 are configured and arranged to align with respective posts 142 on the support member 140. Also, the groove 243 is configured and arranged to align with the groove 143 on the support member 140. In this regard, the grooves 243 and 143 cooperate to define a cylindrical passage that aligns with the holes 133 in associated end plates 130. The cylindrical passage defines a longitudinal axis that extends parallel to the bar 112.

Flanges 247–249 project outward from a side of the base 241 opposite the groove 243, and square holes 257–259 extend through the base 241 proximate respective flanges 247–249 and perpendicular to the associated side of the base 241. The flanges 247–249 are configured and arranged to align axially with respective flanges 147–149 on the support member 140. Also, the holes 257–259 are configured and arranged to align with respective holes 157–159 on the support member 140. A shelf 251 projects outward from the top of the base 241 and is integrally connected to the tops of the flanges 247–249. Nubs 252 and 253 project upward from the shelf 251 and a co-planar portion of the base 241.

Tabs 244–246 project outward from opposite ends of the base 241. The tabs 244–246 are configured and arranged to adjoin and mirror respective tabs 144–146. The tabs 144 and 244 are sized and configured to fit snugly into respective openings 134 in associated end plates 130; the tabs 145 and 245 are sized and configured to fit snugly into respective openings 135 in associated end plates 130; and the tabs 146 and 246 are sized and configured to fit snugly into respective openings 136 in associated end plates 130.

Each support member 140 is connected to a respective support member 240 by inserting respective posts 142 into respective holes 242. A bond between the components may be created by adhesive, molecular bonding, sonic welding, and/or other means known in the art. In any event, the tabs 144–146 and 244–246 cooperate with the end plates 130 to discourage separation of respective support members 140 and 240 from one another, and the posts 142 and the holes 242 cooperate to discourage other forms of relative movement between the support members 140 and 240.

First and second end fasteners 102 are secured to respective ends of the bar 112, preferably in a manner that clamps the other components therebetween. Each end fastener 102 is preferably a self-tapping screw having a shaft that threads into a respective end of the bar 112, and a relatively larger diameter head that overlies a respective outer end plate 130 (in much the same manner as the washers 122 overlie respective inner end plates 130). Also, first and second bolts 103 are inserted through respective end plates 130 and support members 140 and 240 and threaded into respective nuts 104, preferably in a manner that clamps respective end plates 130 and support members 140 and 240 therebetween. The tabs 144–146 and 244–246 are configured to wedge into respective openings 134–136 in respective end plates 130 in response to axially applied clamping force.

On the assembled handle member 110, the bases 141 and 241 are disposed on top of the bar 112, and the flanges 147–148 and 247–248 project outward from opposite sides of the bar 112. The flanges 147–149 and 247–249 cooperate with one another and with the end plates 130 to define respective weight receiving slots for the weight plates 167–169.

One of the weight plates 167 is shown in relatively greater detail in FIGS. 10–13. The weight plate 167 is preferably made of steel and configured to weigh one and one-quarter pounds (or 0.5 kg on a metric embodiment). The weight plate 167 includes a first layer or plate 170 that coincides with the overall planform of the plate 167, and a second layer or boss 173 that projects axially outward from the plate 170 and spans less than the entire planform. Among other things, the boss 173 defines a downwardly facing, internal lip 175. The axially measured thickness of the boss 173 is preferably slightly less than the axially measured thickness of the flanges 147 and 247.

An upwardly opening slot 171 extends through the plate 170 and is configured to receive the bar 112 and the support members 140 and 240. On the depicted embodiment 100, the outwardly facing sidewalls of respective support members 140 and 240 are upwardly divergent to the same extent as the opposite sidewalls of the slot 171. For reasons discussed above with reference to the base 200, the lower end 172 of the plate 170 has less width than the remainder of the plate 170. Also, both the plate 170 and the boss 173 are configured to define downwardly facing shoulders 174 that project outward from opposite sides of the juncture between the lower end 172 and the remainder of the plate 170.

Figure 15:
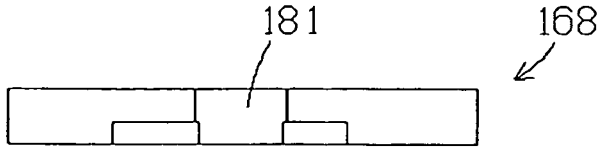
FIG. 15 is a top view of the weight plate of FIG. 14.
Figure 14:
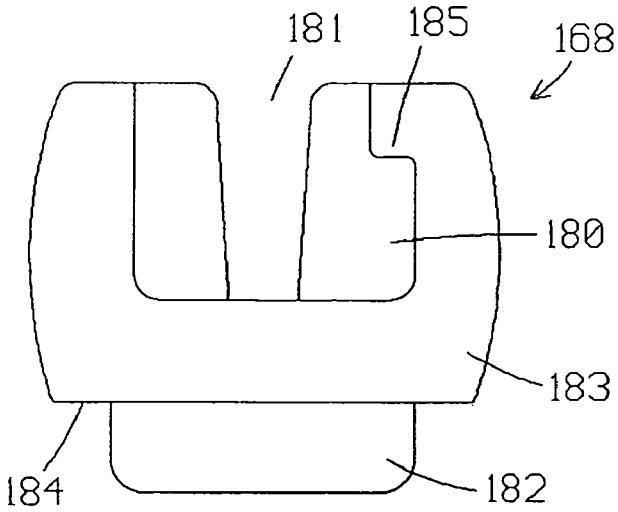
FIG. 14 is an end view of a second weight plate shown in FIG. 1.

One of the weight plates 168 is shown by itself in FIGS. 14–15. The weight plate 168 is preferably made of steel and configured to weigh two and one-half pounds (or 1.0 kg on a metric embodiment). The weight plate 168 includes a first layer or plate 180 that coincides with the overall planform of the plate 168, and a second layer or boss 183 that projects axially outward from the plate 180 and spans less than the entire planform. As on the plate 167, the boss 183 similarly defines a downwardly facing, internal lip 185. Also, the axially measured thickness of the boss 183 is preferably slightly less than the axially measured thickness of the flanges 148 and 248.

An upwardly opening slot 181 extends through the plate 180 and is configured in the same manner as the slot 171 in the plate 170. Also, the lower end 182 of the plate 180 is similarly configured for insertion into a respective slot 208 on the base 200, and both the plate 180 and the boss 183 define downwardly facing shoulders 184 that project outward from opposite sides of the juncture between the lower end 182 and the remainder of the plate 180, and that are configured to rest on opposite sides of the base 200.

Figure 16:
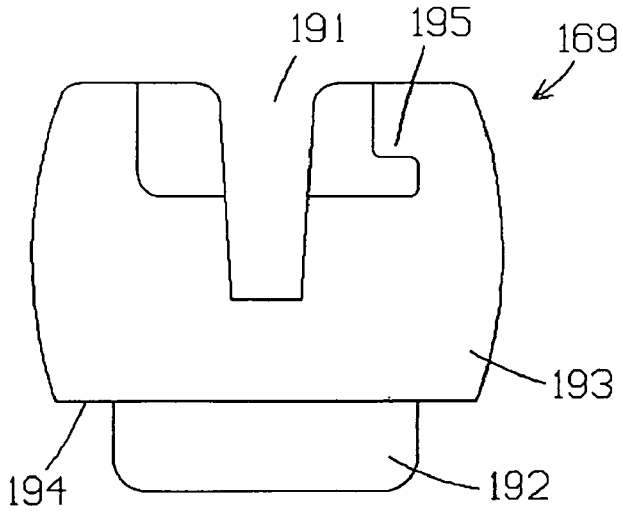
FIG. 16 is an end view of a third weight plate shown in FIG. 1.
Figure 17:
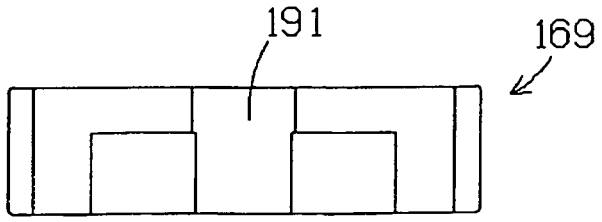
FIG. 17 is a top view of the weight plate of FIG. 16.
Figure 19:
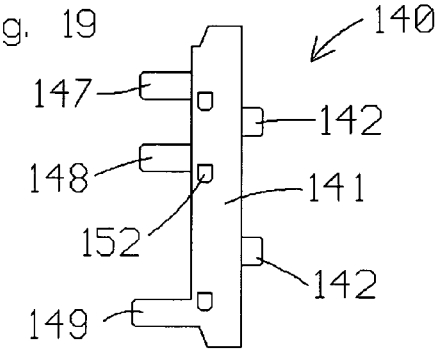
FIG. 19 is a top view of the weight support member of FIG. 18.
Figure 21:
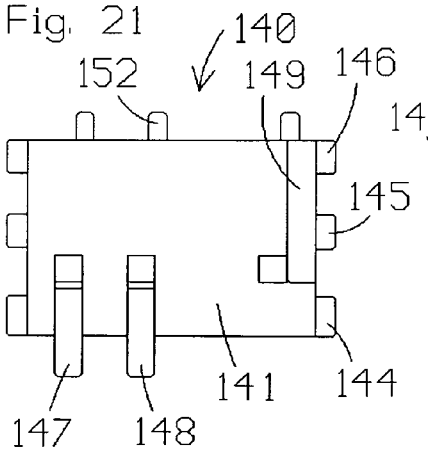
FIG. 21 is a side view of the weight support member of FIG. 18.
Figure 18:
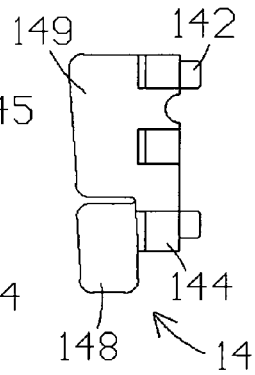
FIG. 18 is an end view of a first weight support member on the handle member of FIG. 1.
Figure 22:
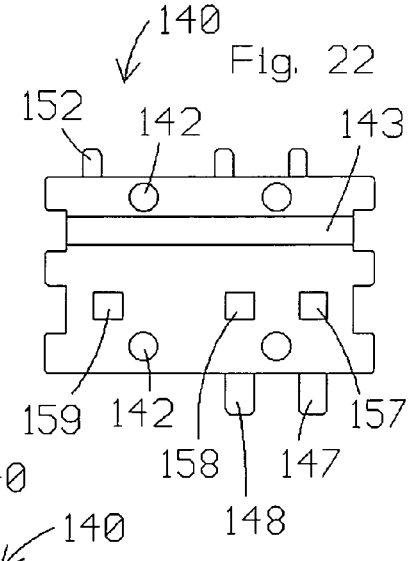
FIG. 22 is an opposite side view of the weight support member of FIG. 18.
Figure 20:
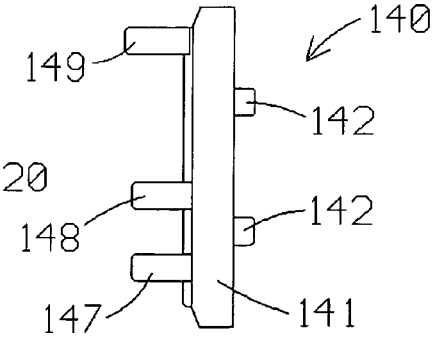
FIG. 20 is a bottom view of the weight support member of FIG. 18.

One of the weight plates 169 is shown by itself in FIGS. 16–17. The weight plate 169 is preferably made of steel and configured to weigh six and one-quarter pounds (or 2.5 kg on a metric embodiment). The weight plate 169 includes a first layer or plate 190 that coincides with the overall planform of the plate 169, and a second layer or boss 193 that projects axially outward from the plate 190 and spans less than the entire planform. As on the plates 167–168, the boss 193 similarly defines a downwardly facing, internal lip 195. Also, the axially measured thickness of the boss 193 is preferably slightly less than the axially measured thickness of the flange 249 on the support member 240. The boss 193 and associated cavity are relatively thicker than those on the other plates 167–168 because the associated holes 159 and 259 are spaced apart from respective end plates 130.

An upwardly opening slot 191 extends through the plate 190 and is configured in the same manner as the slot 171 in the plate 170. Also, the lower end 192 of the plate 190 is similarly configured for insertion into a respective slot 209 on the base 200, and both the plate 190 and the boss 193 define downwardly facing shoulders 194 that project outward from opposite sides of the juncture between the lower end 192 and the remainder of the plate 190, and that are configured to rest on opposite sides of the base 200.

A separate, dedicated weight selector 210 is movably mounted on the handle member 110 for each of the weight plates 167–169 associated with the dumbbell system 100. Each selector 210 includes a selector pin 211 and a selector latch 220. One of the selector pins 211 is shown by itself in FIGS. 5–6. Each pin 211 is preferably an L-shaped bar that is made of steel and has a square profile or cross-section. In other words, each pin 211 includes a first bar segment 212 and a second bar segment 215 that extend perpendicular to one another.

One of the selector latches 220 is shown by itself in FIGS. 7–9. Each latch 220 is preferably made of plastic and formed by injection molding. A first end 221 of the latch 220 is cylindrical and defines a square opening 222 that is sized and configured to receive a distal end of a respective bar segment 212. An opposite, second end 223 of the latch 220 is configured as a hook. A stop or rib 225 projects outward from an intermediate portion of the latch 220, in a direction opposite the hooked end 223.

Each latch 220 is mounted on a respective pin 211 by friction fit. Adhesives, fasteners, and/or spring detents may be used, as well. An opposite, distal end of each pin 211 is inserted through respective holes 157–159 and 257–259 in the support members 140 and 240. The holes 157–159 and 257–259 are sized and configured to accommodate sliding of the pins 211 relative to the support members 140 and 240 (with as little "slop" as possible). The space between each bar segment 215 and a respective latch 220 is sufficient to accommodate respective support members 140 and 240 therebetween.

As shown in FIG. 1, each selector 210 is movable between a first position (shown on the left side of the handle member 110) wherein the stop 225 is adjacent a respective peg 152, and a second position (shown on the right side of the handle member 110) wherein the hooked end 223 has snapped into place just beyond a respective nub 252 or 253. In this regard, each latch 220 may be described as a leaf spring that deflects to accommodate travel of a respective hooked end 223 relative to a respective nub 252 or 253.

The selectors 210 at respective ends of the handle member 110 operate in opposite directions because the components at one end of the handle member 110 are rotated one hundred and eighty degrees relative to the components at the other end of the handle member 110. An advantage of this arrangement is that identical components may be used at each end of the dumbbell 100.

Figure 13:
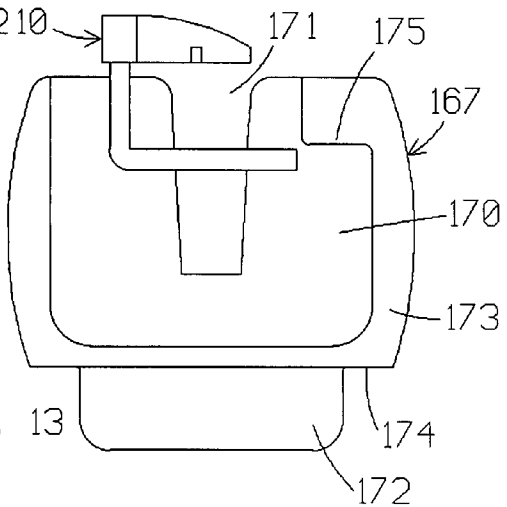
FIG. 13 is an end view of the weight plate, selector pin, and selector latch of FIG. 10, showing the selector pin and the selector latch in an alternative, disengaged position relative to the weight plate.

When the selectors 210 are arranged as shown on the left side of the handle member 110 in FIG. 1, the associated selector pins 211 occupy respective positions analogous to those shown in FIG. 13 with reference to one of the weight plates 167. Under such circumstances, the selector 210 and the handle member 110 are free to move upward relative to the weight plate 167. On the other hand, when the selectors 210 are arranged as shown on the right side of the handle member 110 in FIG. 1, the associated selector pins 211 occupy respective positions analogous to those shown in FIG. 10 with reference to the same weight plate 167 (the pin extends beneath the lip 175). Under such circumstances, the weight plate 167 is constrained to move upward together with the selector 210 and the handle member 110. The selector is subject to the weight of the weight plate acting in a first direction; moves in a second, orthogonal direction relative to the handle member to engage the weight; and is latched to the handle member by movement in a third, orthogonal direction.

When all of the weight selectors 210 are moved to respective "disengaged" positions (as on the left side of FIG. 1), none of weight plates 167–169 is secured to the handle member 110, which by itself is preferably configured to weigh two and one-half pounds (or 1.0 kg on a metric embodiment). When all of the weight selectors 210 are moved to respective "engaged" positions (as on the right side of FIG. 1), all of the weight plates 167–169 are secured to the handle member 110, which will now weigh twenty-two and one-half pounds (or 9.0 kg on a metric embodiment) when lifted from the base 200. The following chart shows the different amounts of "perceived" balanced weight that are available with the dumbbell system 100. With regard to the concept of "perceived" balanced weight, the weight of 12.5 pounds is achieved by selecting the weight plates 167 and 168 at one end of the handle member 110, and the weight plate 169 at the other end of the handle member 110. Although more weight is selected at one end than the other, a relatively greater moment arm is associated with the relatively lighter weight, thereby providing a relatively balanced feel.

| Handle | Weights 167 | Weights 168 | Weights 169 | Total |
|---|---|---|---|---|
| 2.5 | 0 | 0 | 0 | 2.5 |
| 2.5 | 2.5 | 0 | 0 | 5.0 |
| 2.5 | 0 | 5.0 | 0 | 7.5 |
| 2.5 | 2.5 | 5.0 | 0 | 10.0 |
| 2.5 | 1.25 | 2.5 | 6.25 | 12.5 |
| 2.5 | 0 | 0 | 12.5 | 15.0 |
| 2.5 | 2.5 | 0 | 12.5 | 17.5 |

-continued

| Handle | Weights 167 | Weights 168 | Weights 169 | Total |
|---|---|---|---|---|
| 2.5 | 0 | 5.0 | 12.5 | 20.0 |
| 2.5 | 2.5 | 5.0 | 12.5 | 22.5 |

An advantage of the dumbbell system 100 is that only three discrete weight plates are required at each end of the dumbbell to provide nine different dumbbell loads that include eight truly balanced loads and one seemingly balanced load. Another advantage of the dumbbell system 100 is that eight additional, somewhat out of balance loads may be selected, as well. For example, the handle member 110 may be set to weigh eighteen and three-quarter pounds by engaging the weight plates 167 and 169 at one end of the handle member 110, and by engaging the weight plates 168 and 169 at the other end of the handle member 110.

The foregoing system 100 constitutes only one particular embodiment of the subject invention. Various changes may be made to the dumbbell system 100 to arrive at alternative embodiments and/or applications of the subject invention. For example, the weight plates may be arranged in a different order, and/or provided in different numbers and/or weight amounts.

Figure 31:
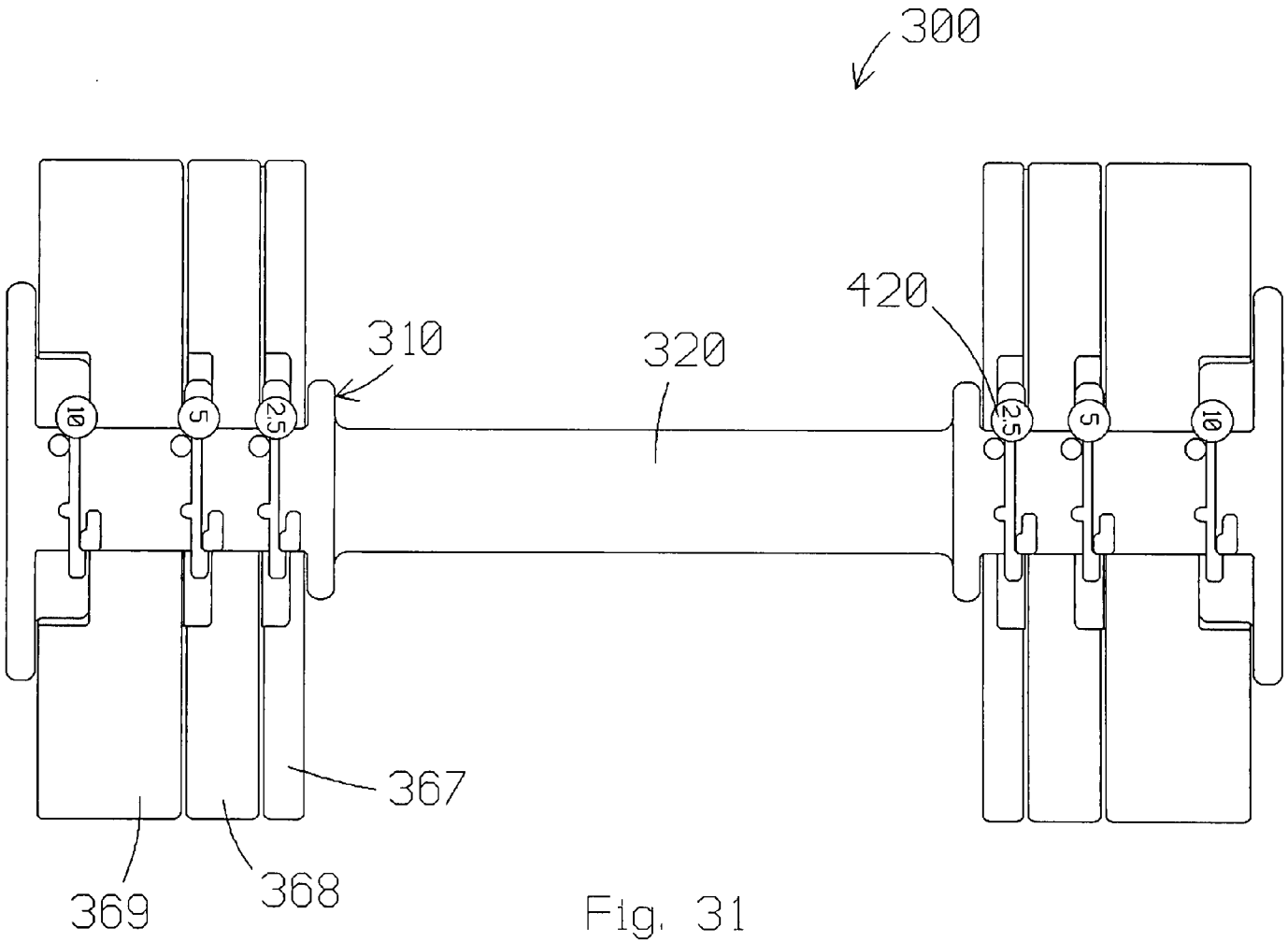
FIG. 31 is a top view of an alternative embodiment adjustable weight dumbbell constructed according to the principles of the present invention.
Figure 32:
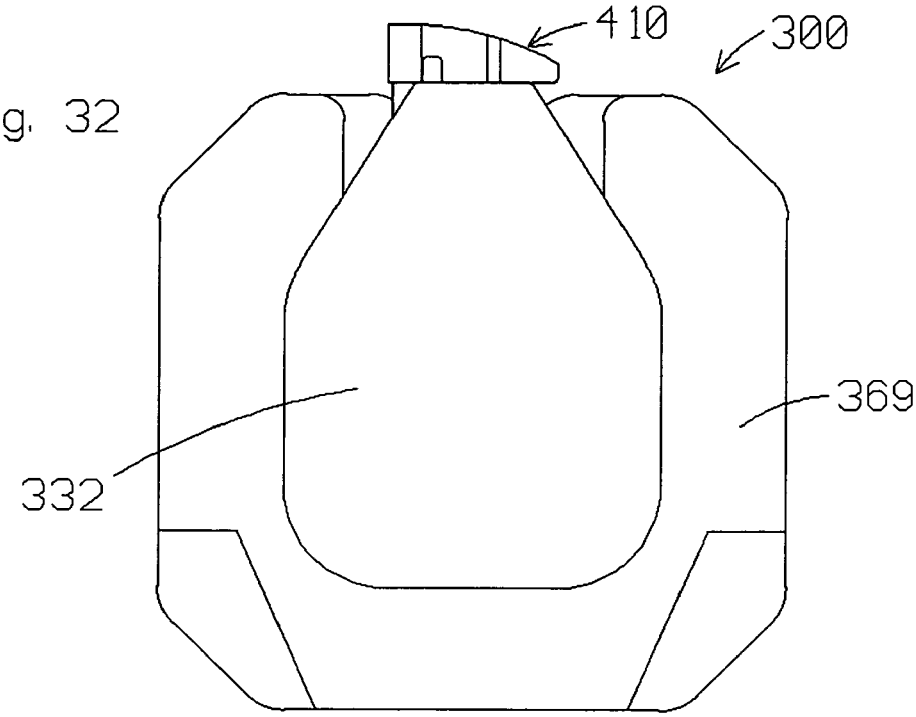
FIG. 32 is an end view of the dumbbell of FIG. 31.

FIGS. 31–32 show another dumbbell 300 constructed according to the principles of the present invention. The dumbbell 300 similarly includes a weight lifting member or handle member 310 and a plurality of weight plates 367–369, and is preferably used together with a base (not shown) that supports the weight plates 367–369 when not in use. In fact, the dumbbell 300 is similar in many respects to the previous embodiment 100, and thus, the following description will focus on the distinctions.

The dumbbell 300 includes an integrally formed handle member 310 that is shown in FIGS. 34–35 without its weight selectors 410. The handle member 310 includes a central hand grip 320 and opposite ends that are configured to accommodate respective weight plates 367–369. Each end portion includes a bar 341 that has a rectangular cross-section, and that is bounded by an inner end plate 331 and an outer end plate 332. Flanges or spacers 347–349 extend radially outward from the bar 341 at axially spaced locations between the end plates 331 and 332. Circular holes 357–359 extend through the bar 341 in a direction perpendicular to the longitudinal axis of the hand grip 320, and at axially spaced locations that align with respective flanges 347–349.

At each end of the handle member 310, a top plate 351 extends between an upper end of the inner end plate 331 and an upper end of the outer end plate 332. In other words, the top plate 351 cooperates with the end plates 331 and 332 to define an inverted U-shaped configuration. Nubs 353 and pegs 355 project upward from the top plate 351 and cooperate with weight selectors 410 in the same manner as their counterparts on the previous embodiment. In this regard, the weight selectors 410 similarly include L-shaped bars that insert through respective holes 357–359, and latches 420 that are mounted on top of respective bars and disposed between respective nubs 353 and pegs 355. As shown in FIG. 31, indicia may be provided on the latches 420 to indicate the weight of an associated weight plate.

Figure 33:
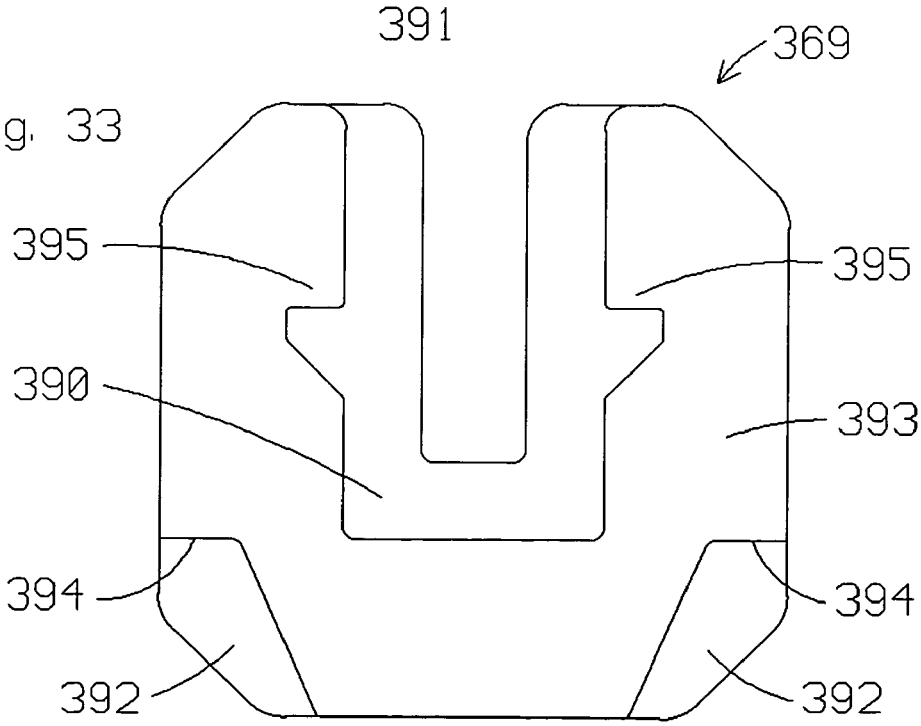
FIG. 33 is an end view of a weight plate on the dumbbell of FIG. 31.

FIG. 33 shows one of the weight plates 369 by itself. Like the weight plates 167–169, the weight plate 369 includes a first layer or plate 390 that coincides with the overall planform of the plate 369, and a second layer or boss 393 that projects axially outward from the plate 390 and spans less than the entire planform. An upwardly opening slot 391 extends through the plate 390 and is configured to receive the bar 341. Opposite left and right sides of both the plate 390 and the boss 393 are configured to be identical. The boss 393 does not extend to the lower corners 392 of the plate 390, thereby defining lower plate corners 392 that are configured for insertion into opposite sides of an appropriately configured base. The boss 393 defines downwardly facing, internal lips 395 on opposite sides of the slot 391, and downwardly facing, external shoulders 394 that may rest on opposite sides of the base.

The other weight plates 367–368 have similar plate and boss profiles, but different thicknesses. Because the weight plates are reversible and the handle member 310 is integrally formed, the two sets of weight selectors may be configured and arranged to operate in the same direction, while using the same tooling for the parts at each end. The handle member 310 and the associated base are configured to support the weight plates in reverse order of those on the previous embodiment 100. In this regard, the smallest or lightest weight plate 367 is nearest the hand grip 320, and the biggest or heaviest weight plate 369 is farthest from the hand grip 320. An advantage of this arrangement is that the smallest available "out of balance" loads are closer to the hand grip 320.

With the empty handle member 310 configured to weigh five pounds, and the weight plates 367–369 configured to weigh as indicated on the associated latches 420, the dumbbell 300 is designed to provide eight balanced weights from five to forty pounds (in increments of five pounds), and seven additional weights (that are two and one-half pounds out of balance).

Figure 36:
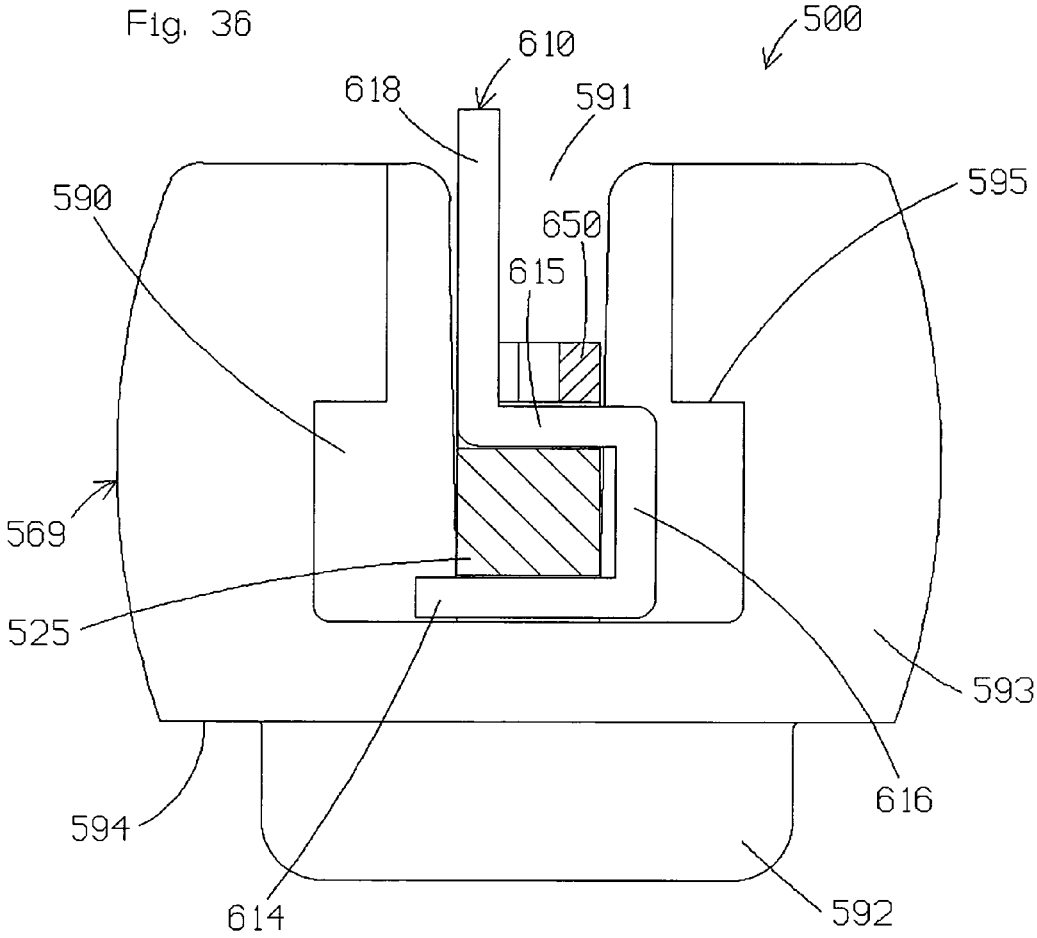
FIG. 36 is a sectioned end view of another adjustable weight dumbbell constructed according to the principles of the present invention.

FIG. 36 shows yet another dumbbell 500 constructed according to the principles of the present invention. The dumbbell 500 similarly includes a weight lifting member or handle member 510 and a plurality of weight plates (one of which is designated as 569), and is preferably used together with a base that supports the weight plates when not in use. This dumbbell 500 shares many attributes with the foregoing embodiment 300, so the following description will focus on the distinctions.

Figure 38:
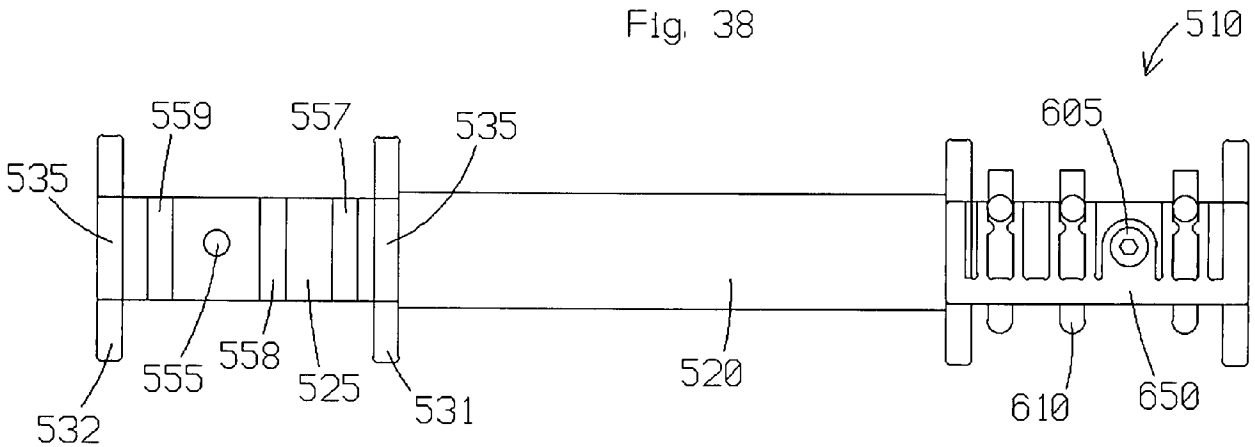
FIG. 38 is a top view of a partially assembled handle member that is a part of the dumbbell of FIG. 36.
Figure 39:
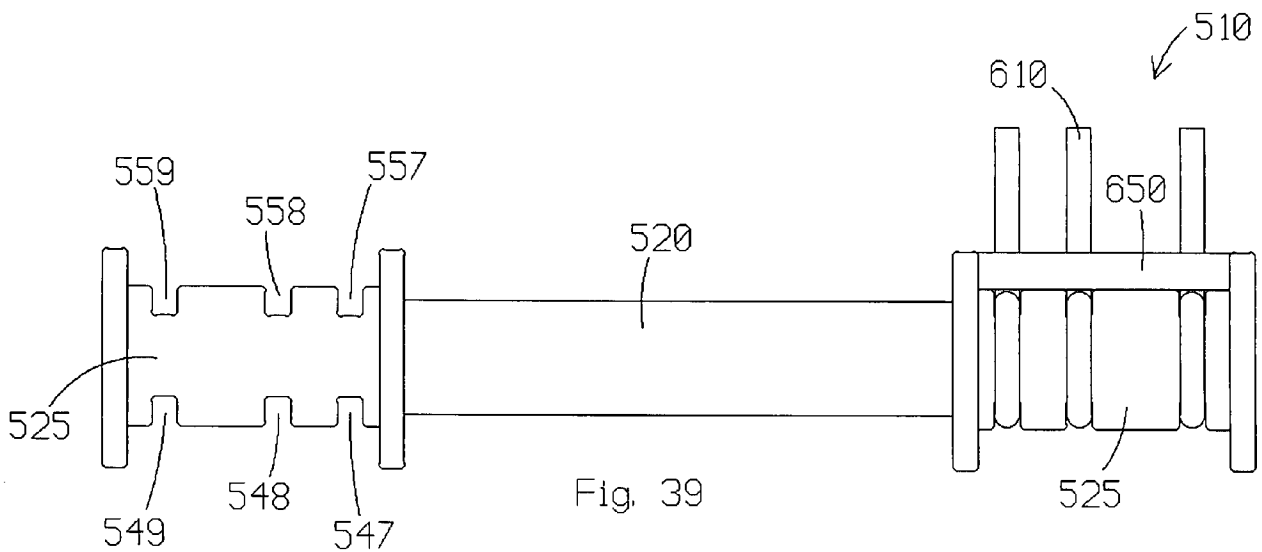
FIG. 39 is a side view of the partially assembled handle member of FIG. 38.

The dumbbell 500 includes an integrally formed handle member 510 that is somewhat less complicated than its counterpart on the dumbbell 300. FIGS. 38–39 show the left end of the handle member 510 with the integrally formed portion by itself, and the right end of the handle member 510 with associated weight selectors 610 and associated latches 650. The handle member 510 includes a central hand grip 520 and opposite ends that are configured to accommodate respective weight plates. Each weight support includes a bar 525 that has a rectangular cross-section, and that is bounded by an inner end plate 531 and an outer end plate 532. Upwardly opening notches 535 are provided in the end plates 531 and 532 to accommodate mounting of the latches on the handle member 510. Axially spaced grooves 557–559 are formed in a top side of each bar 525, and extend in a direction perpendicular to the longitudinal axis of the hand grip 520. Similar axially spaced grooves 547–549 are formed in an opposite, bottom side of each bar 525. Also, at least one hole 555 extends downward into the top side of each bar 525 to receive a fastener associated with the latches.

FIG. 36 shows one of the weight selectors 10 relative to the handle member 510 and an associated weight plate 569. The weight selector is preferably a steel bar having an upwardly extending operator portion 618, and a generally C-shaped weight engaging portion that is connected to a lower end of the operator portion 618. The weight engaging portion includes a lower segment that extends through a respective groove 549, an upper segment 615 that extends through a respective groove 559, and an intermediate segment 616 interconnected therebetween. At least the intermediate segment 616 is configured and arranged to function as a spacer between adjacent weight plates.

FIG. 36 shows one of the weight selectors 610 in a "disengaged" position relative to its respective weight plate 569. Like the weight plates 367–369, the weight plate 569 includes a first layer or plate 590 that coincides with the overall planform of the plate 569, and a second layer or boss 593 that projects axially outward from the plate 590 and spans less than the entire planform. An upwardly opening slot 591 extends through the plate 590 and is configured to receive the bar 525. Opposite left and right sides of both the plate 590 and the boss 593 are configured to be identical. The lower end 592 of the weight plate 569 is configured like those on the first embodiment 100 for insertion into a base similar to the base 200. Both the plate 590 and the boss 593 define downwardly facing, external shoulders 594 that are configured to rest on opposite sides of the base. Also, the boss 593 defines downwardly facing, internal lips 595 on opposite sides of the slot 591.

The other weight plates have similar plate and boss profiles, but different thicknesses. Because the weight plates are reversible and the handle member 510 is integrally formed, the two sets of weight selectors may be configured and arranged to operate in the same direction, while using the same tooling for the parts at each end.

The weight selector 610 shown in FIG. 36 is movable to the right and beneath a respective lip 595 in order to engage the associated weight plate 569. If desired, the lower grooves 547–549 may be replaced by holes to enhance the "lifting capacity" of the selectors 610 by providing an additional level of support against downward movement of the weight plate 569. A latch is preferably provided to bias the weight selector 610 to remain in either the disengaged position or the engaged position. On this embodiment 500, the latch is mounted on the handle member 510, rather than the weight selector 610.

Figure 37:
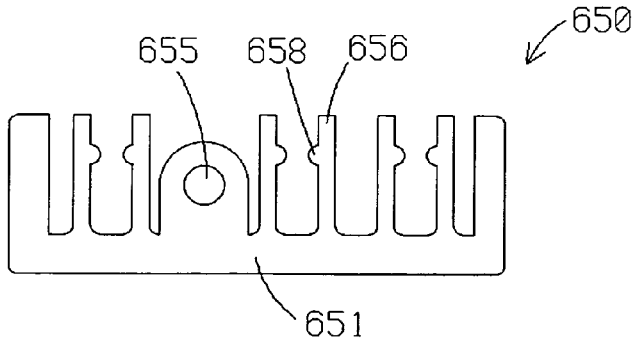
FIG. 37 is a top view of a selector latch that is a part of the dumbbell of FIG. 36.

FIG. 37 shows one of the latch members 650 by itself. The latch members 650 are preferably made of plastic and formed by injection molding. The latch member 650 at one end of the handle member 510 is flipped end over end relative to the latch member 650 at the other end of the handle member 510. The latch member 650 includes a base 651, at least one hole 655 extending through the base 651 for mounting purposes, and at least one flexible finger 656 for each associated weight selector 610.

The base 651 is configured for insertion into the notches 535 in the end plates 531 and 532, and the hole 655 is configured and arranged to align with the hole 555 in a respective bar 525. A fastener 605 is inserted through the hole 555 and threaded into the hole 555 to secure the latch member 650 in place. For each weight selector 610, a pair of resilient fingers 656 project outward from the base 651 and straddle the weight selector 610. Opposing nubs 658 project outward from respective fingers 656 and toward one another. The nubs 658 require the fingers 656 to deflect away from the weight selector 610 to accommodate its movement between a "disengaged" position and an "engaged" position.

The present invention may also be described in terms of various methods of adjusting resistance to exercise, with reference to one or more of the embodiments disclosed herein. For example, one such method involves providing a handle member having a hand grip that defines a longitudinal axis, a first end that is configured to accommodate a plurality of weights, and an opposite, second end that is configured to accommodate a plurality of weights; providing first end weights configured to be supported in respective, axially spaced positions at the first end of the handle member, wherein the first end weights include a first weight and a second weight; providing second end weights configured to be supported in respective, axially spaced positions at the second end of the handle member, wherein the second end weights include a third weight and a fourth weight; for each said weight, providing a dedicated weight selector movably mounted on the handle member; and selectively moving each desired weight selector between a first position, free to move upward relative to a respective said weight, and a second position, underlying a portion of a respective said weight.

Such a method may further involve providing a base configured to support the weights in a rest position; providing openings in the handle member for purposes of movably mounting the weight selectors on the handle member; providing latching means for latching each said weight selector in its second position; and/or providing each of the weights with an axially extending lip to be engaged by a respective weight selector.

The present invention has been described with reference to specific embodiments and particular applications which will enable persons skilled in the art to derive additional embodiments and/or applications. Among other things, the weight plates may be configured to receive the handle member in different ways; the weight selectors may be configured to move in different directions or at different locations relative to the handle member; and/or various types of biasing mechanisms may be used to latch the weight selectors in place. Moreover, features of the disclosed embodiments and/or methods may be mixed and matched in numerous ways to arrive at additional variations of the present invention. In view of the foregoing, the scope of the present invention is to be limited only to the extent of the following claims.

What is claimed is:

1. An exercise dumbbell, comprising:

a handle member having an intermediate hand grip that defines a longitudinal axis, and opposite ends that are configured to accommodate respective weight plates;

a plurality of weight plates, including a first weight plate having a boss that defines an axially projecting lip; and a second weight plate having a boss that defines an axially projecting lip; and a plurality of weight selectors movably mounted on the handle member, including a first weight selector that is configured and arranged to slide beneath the lip on the first weight, and a second weight selector that is configured and arranged to slide beneath the lip on the second weight.

2. The exercise dumbbell of claim 1, further comprising a base configured to support the weight plates in a rest position.

3. The exercise dumbbell of claim 1, wherein each said weight selector includes a first bar segment and a second bar segment that extend perpendicular to one another.

4. The exercise dumbbell of claim 3, wherein each said weight selector further comprises a latch mounted on a respective first bar segment in a manner that defines a generally U-shaped configuration.

5. The exercise dumbbell of claim 4, wherein each said latch cooperates with the handle member to limit movement of a respective weight selector relatively to a respective weight plate.

6. The exercise dumbbell of claim 5, wherein each said latch is configured as a leaf spring, and is arranged to snap into engagement with a respective nub on the handle member as a respective second bar segment is moved to a position beneath the lip on a respective weight plate.

7. The exercise dumbbell of claim 1, wherein each said weight selector includes a bar segment that extends through a respective opening in the handle member.

8. The exercise dumbbell of claim 7, wherein at least one said opening is axially aligned with a flange on the handle member that extends between adjacent weight plates.

9. The exercise dumbbell of claim 1, wherein each said weight plate has an upwardly opening slot configured to receive a respective end of the handle member.

10. The exercise dumbbell of claim 1, wherein each said weight plate includes a plate portion, and a boss portion that projects axially outward from the plate portion and defines both the lip and a space to accommodate a respective weight selector.

11. An exercise dumbbell, comprising:

weight plates;

a handle member having an intermediate hand grip that defines a longitudinal axis, wherein axially spaced openings extend through the handle member in a first direction perpendicular to the longitudinal axis;

weight selectors configured for insertion into respective openings in the handle member in said first direction and into engagement with respective weight plates in a second direction that is both perpendicular to the first direction and the longitudinal axis; and a base configured to maintain the weight plates in position to receive respective weight selectors when the handle member rests on at least one of the base and the weight plates.

12. The exercise dumbbell of claim 11, further comprising latching means for latching the weight selectors in engaged positions relative to respective weight plates.

13. The exercise dumbbell of claim 12, wherein the handle member is selectively movable in a first direction relative to the weight plates, and the weight selectors are selectively movable in a second direction relative to the handle member, and the latching means acts in a third direction, and each said direction is perpendicular to every other said direction.

14. The exercise dumbbell of claim 11, wherein each of the weight plates has an axially extending lip, and each of the weight selectors is selectively movable beneath a respective lip.

15. The exercise dumbbell of claim 11, wherein axially spaced flanges extend radially outward from the handle member and align with respective openings.

16. An exercise dumbbell, comprising:

a handle member having a hand grip that defines a longitudinal axis, a first end that is configured to accommodate a plurality of weights, and an opposite, second end that is configured to accommodate a plurality of weights;

a plurality of first end weights configured to be supported in respective, axially spaced positions at the first end of the handle member;

a plurality of second end weights configured to be supported in respective, axially spaced positions at the second end of the handle member; and for each one of said weights, a dedicated weight selector movably mounted on the handle member and movable linearly between a first position, underlying a portion of a respective said one of said weights, and a second position, free to move linearly upward relative to a respective said one of said weights.

17. The exercise dumbbell of claim 16, further comprising a base configured to support the weights in a rest position.

18. The exercise dumbbell of claim 16, wherein each said weight selector extends through a respective opening in the handle member.

19. The exercise dumbbell of claim 16, further comprising latching means for latching each said weight selector in its first position.

20. The exercise dumbbell of claim 16, wherein each said portion is an axially extending lip.

* * * * *